US007543766B2

(12) United States Patent
Dobson

(10) Patent No.: US 7,543,766 B2
(45) Date of Patent: Jun. 9, 2009

(54) METHOD AND APPARATUS FOR DISPENSING MEDICATION

(75) Inventor: Keith Dobson, Victoria (AU)

(73) Assignee: Liquitab Systems Limited, Strathmore, Victoria (AU)

( * ) Notice: Subject to any disclaimer, the term of this patent is extended or adjusted under 35 U.S.C. 154(b) by 0 days.

(21) Appl. No.: 10/344,974

(22) PCT Filed: Aug. 17, 2001

(86) PCT No.: PCT/AU01/01025

§ 371 (c)(1),
(2), (4) Date: May 1, 2003

(87) PCT Pub. No.: WO02/13754

PCT Pub. Date: Feb. 21, 2002

(65) Prior Publication Data

US 2003/0168538 A1 Sep. 11, 2003

(30) Foreign Application Priority Data

Aug. 18, 2000 (AU) ..... PQ9490
Feb. 19, 2001 (AU) ..... PR3200

(51) Int. Cl.
*B02C 19/00* (2006.01)
*B02C 13/286* (2006.01)

(52) U.S. Cl. ..... 241/1; 241/301; 241/DIG. 27

(58) Field of Classification Search ..... 241/1, 241/301, DIG. 27
See application file for complete search history.

(56) References Cited

U.S. PATENT DOCUMENTS

| | | | | | |
|---|---|---|---|---|---|
| 3,467,500 | A | * | 9/1969 | Green et al. | 436/45 |
| 3,542,345 | A | * | 11/1970 | Kuris | 366/113 |
| 3,788,815 | A | | 1/1974 | Rohrbaugh | |
| 3,966,899 | A | * | 6/1976 | Nakai et al. | 424/468 |
| 4,720,374 | A | * | 1/1988 | Ramachandran | 422/310 |
| 4,856,909 | A | * | 8/1989 | Mehta et al. | 366/208 |
| 5,067,666 | A | | 11/1991 | Sussman | |
| 5,174,508 | A | * | 12/1992 | Martin | 241/21 |
| 5,618,004 | A | | 4/1997 | Klearman et al. | |

* cited by examiner

*Primary Examiner*—Bena Miller
(74) *Attorney, Agent, or Firm*—Edwin D. Schindler

(57) ABSTRACT

A method for converting a tablet containing medication into a palatable fluid includes the steps of adding a palatable fluid to a container, placing the tablet containing the medication and then disintegrating the tablet/fluid combination until the table is disintegrating the tablet/fluid combination until the tablet is disintegrated and dispersed throughout the palatable fluid for forming a palatable mixture in the container for ingestion by a patient. An apparatus for carrying out the method uses either an ultrasonic device, such as a ultrasonic probe, or a crushing device for disintegrating and dispersing the tablet throughout the palatable fluid.

11 Claims, 1 Drawing Sheet

METHOD AND APPARATUS FOR DISPENSING MEDICATION

TECHNICAL AREA

This invention relates to the administration of medication and in particular to a means of processing tablets, to be ingested by patients, into a palatable form in a manner which minimises the possibility of one patient's medication being contaminated by another patient's medication, improves compliance rates and increases dispensing efficiency.

BACKGROUND TO THE INVENTION

Despite technological advances in the medical area it is still common practice where medication such as tablets are used, for nursing staff to crush these with a mortar and pestle or alternatively with some mechanical crushing means and mix the residue with some palatable substance.

This practice not only produces a gritty result but leads to the possibility that a further patient may be cross medicated with the residue of a previous patient's medication. If some processing of tablet material is not carried out however it is possible for patients to have difficulty swallowing their medication or alternatively they may not take it at all.

The practice described is time consuming for staff and is a particular problem in the areas of treatment of the aged, children and adolescents, those in psychiatric facilities, prisons, those requiring drug and alcohol related services and the like where it is essential that doses of medication prescribed be ingested in accordance with the relevant prescription.

Injections can sometimes be an alternative to oral medication particularly where a patient, or an animal, refuses to swallow medication however a more preferable approach would be to provide medication in a form which was palatable to the patient and permitted the person administering the medication to see that it had been ingested. This is of particular relevance where medication is being administered by untrained staff such as in a hostel environment.

OUTLINE OF THE INVENTION

It is an object of this invention to minimise the problems outlined above by providing a means whereby medication can be finely ground and dispensed in individual units such that the dispensing means is clean after use thereby minimising any possibility of drug cross-contamination.

Although the invention can be used to process any type of tablet or other relatively hard material whether it be for medicinal purposes or other, such as vitamin tablets and the like, for convenience sake it will be discussed herein in respect of its application to tablet type material such as is used for medication.

The invention in one aspect is a process for converting tablet type material into a palatable fluid including the steps of:

- placing tablet type material in a container;
- applying automatic tablet disintegrating means to the tablet type material;
- mixing disintegrated tablet type material with a palatable fluid; and
- discarding or washing the container after the mixture has been ingested.

In another aspect of the invention an apparatus is provided for converting tablet type material into a palatable fluid which apparatus includes a removeable container, into which tablet type material and a fluid can be placed, and processing means for automatically disintegrating the tablet type material in the container such that the tablet type material can be ingested in a fluidised form when mixed with the fluid.

It is preferred that the tablet disintegration and mixing be effected by ultrasonic breakdown of the tablet type material and concurrent mixing with a palatable fluid, preferably a liquid. It is further preferred that the ultrasonic breakdown of the tablet type material be effected using an ultrasonic probe which may have a preferred frequency which is above 20 kHz.

After the tablet type material is mixed with the fluid the container can then be removed from the apparatus and its contents ingested by a patient.

It is further preferred that the container be disposable thereby removing any possibility of cross contamination of patients' medication.

It may be preferred that a flavoured fluid be used or that flavoured tablet material be added to that being disintegrated and used in association with a fluid such as water. In any embodiment of the invention which includes a mechanical means of crushing the tablet type material the apparatus would preferably be provided with means to clean the device after the container is removed.

It is preferred that such cleaning means be automatic, and be associated with reservoirs for clean and dirty water, and be actuated by the removal of the container however it is envisaged that a hand held, battery operated version of the invention could be manually cleaned.

It is further preferred that an embodiment of the invention with mechanical crushing means comprise a blade device mounted on a spindle which blade device, upon activation of the motor, enters the container. It is also preferred that a capping device attached to the spindle above the blade also enter the container to avoid splashing.

It is preferred in any embodiment of the apparatus that it be activated by switch means and be preset to operate for a given time.

It is also preferred in a mechanical embodiment of the invention that the upper edge of the container have at least one step in its periphery so that rotation of the spindle causes the blade to move in the vertical as well as horizontally to facilitate a fine crushing process.

While the breakdown of the tablet type material is discussed herein in terms of disintegration, breakdown and crushing it is to be understood that any method may be used and that this will include degranulation, maceration, liquification and other such processes.

In order that the invention may be more readily understood we shall describe by way of non limiting example a specific embodiment thereof with reference to the accompanying drawing.

BRIEF DESCRIPTION OF THE DRAWING FIGURES

Figure 2:
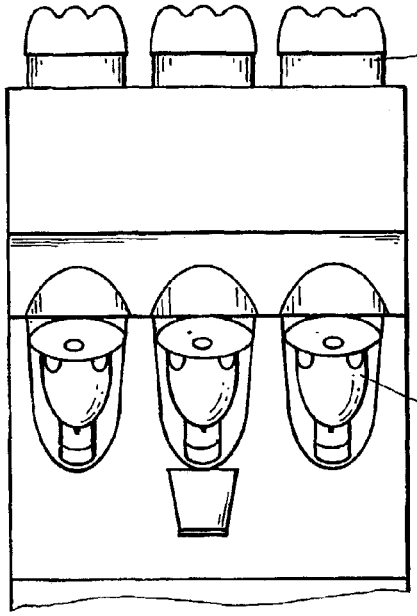
FIG. 2 shows a front view of the upper part of the dispenser apparatus.
Figure 1:
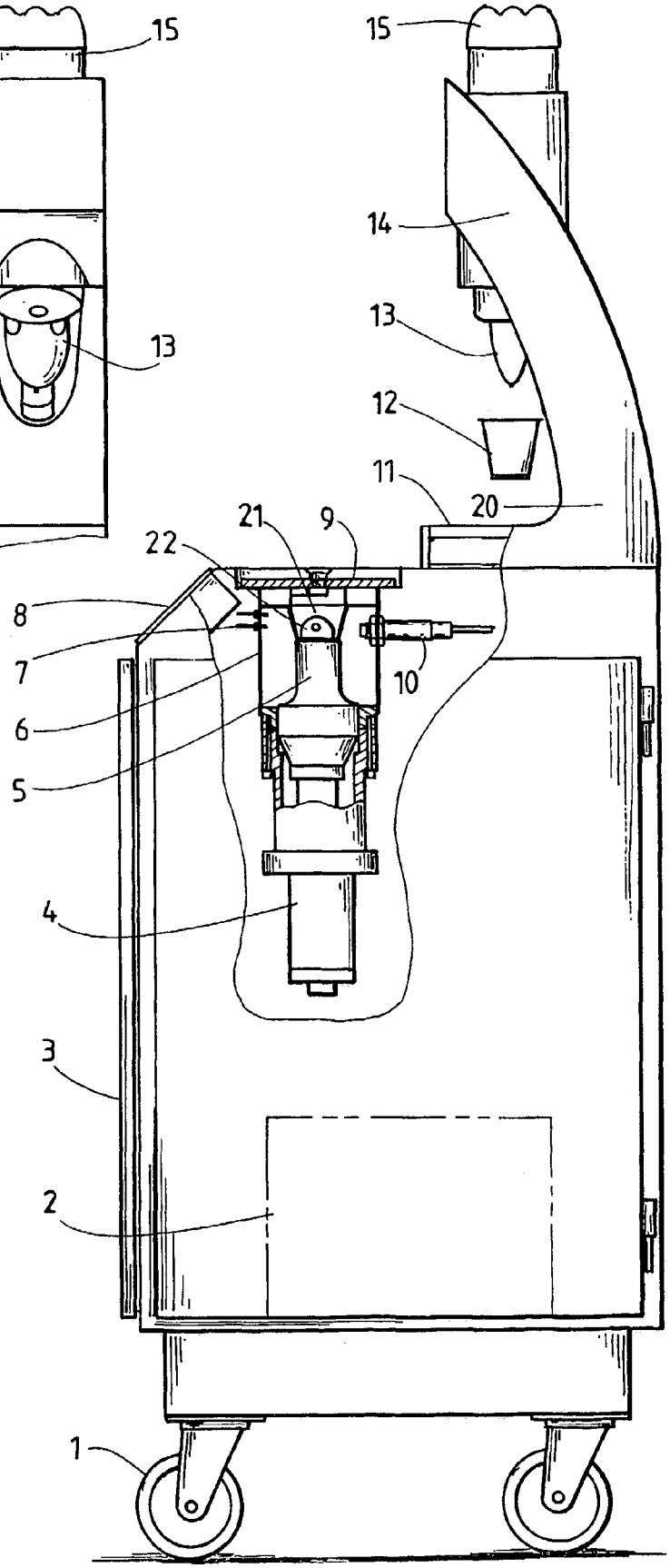
FIG. 1 shows a partially excised side view of an embodiment of the dispenser apparatus.

In a first embodiment of the invention shown in FIG. 1 the invention is mounted in a device which is a cabinet 3 with wheels 1 which is able to be moved to wherever it is required. The unit is provided with fluid dispensers 13 cooperating with fluid storage bottles 15 mounted in housing 14. Although three such dispensers are shown any number of such dispensers may be used.

The operator of the device places the tablet type (hereinafter referred to as tablet) material into a plastic cup 12 and adds a chosen fluid from a bottle 15 using a manual push button 13 on the dispenser thereby adding a fixed volume of the chosen fluid. The precise means of dispensing the fluid is not however germane to the invention however in this embodiment of the invention a drip tray 11 is provided below the dispensers.

Interior to cabinet 3 is an ultrasonic generator 2, which is powered by a conventional electrical source in this embodiment of the invention, which is associated with an ultrasonic probe 4 having a flat topped horn 5, upon which the container 12 can rest, located in a well 6. The container is supported by a cup guide 21 and is locked into position with lid or door 9.

The cup guide 21 is provided with apertures 22 which permit fiber optic sensors 7 to view the container contents and also permit an infra red temperature transducer 10 to view the contents.

The two fiber optic sensors 7 detect the presence of the container 12 and the liquid level within it respectively. Also provided is a limit switch which detects whether the door is closed. This information is displayed on a controller screen 8 and when positive signals are received from all sensors, an operator can press the start switch and observe a message on the controller screen indicating that the device is "in process".

The ultrasonic probe generates the vibration for a pre-set time required for disintegrating and dispersing the tablet material after which the device turns itself off and displaying the message "completed".

If the fluid mixture is becoming overheated this is sensed by the temperature transducer and further processing ceases. It has been found that ultrasonic mixing can elevate the temperature of the mixture however it has also been found that this can be compensated for if required by providing a pre-cooled fluid. It is envisaged that the device could have a cooling mechanism however it may well be desirable to elevate the temperature of the mixture as the result may be more palatable to a patient.

When crushing and mixing is complete the container is removed from the device and the patient is able to ingest the medication in the form of a liquid. Where the container is disposable there is no possibility of cross contamination of medication and the device is ready for reuse for another patient immediately, it is not however an essential feature of the invention that the container be disposable although it is desirable. As the crushing and mixing is automated there is consequently a great saving in the time required to dispense medication to a number of patients particularly where disposable containers are used. In addition the person dispensing the medication can ensure that it is in fact ingested by the patient when the medication is in a fluidised form.

It is envisaged that this device could also be used to incorporate medication into foodstuffs, such as for the elderly, where the food needs to be taken in a fluid form.

It is further envisaged that the device of the invention could be located on a medication trolley or be provided in a portable form and be able to be operated using any appropriate power source.

In a second embodiment of the invention the tablet crushing apparatus or device is associated with two water tanks, one for clean water and another for waste water. The device has a door through which a container may be introduced with the tablet material to be crushed. The container enters a housing in the device and, upon depression of a switch, an electric motor in the device is activated which causes a blade to be lowered on a spindle into the container and rotate within guides located therein for a predetermined time.

Also attached to the spindle is a hood device which abuts the inner upper edge of the container and prevents splashing within the device.

As the upper surface of the container is stepped or toothed in shape, four such steps have been found to be effective, the spindle and blade move up and down as the blade rotates this process helping to achieve very fine maceration of the tablets. At the commencement of the crushing and mixing process a chosen flavoured fluid is fed into the container so that the resulting medication effectively becomes a syrup which is easily ingested by a patient.

While the motor is active the door cannot be opened however removal of the container causes clean water to enter the device which then self cleans either by a switching mechanism associated with the base of the container or by activation of a switch on the device. The waste water then drains away to a waste water container.

In this embodiment of the invention the tablet containers are also disposable and a range of flavoured syrups is provided in a dispenser associated with the device.

The result is that tablet material which is inexpensive can be converted to a fluid which is easily ingested. This not only makes the medication easier to take but prevents patients from actually avoiding taking medication by hiding tablets and the like.

The devices of the invention can also be used for processing tablets which would normally have an enteric coating where this coating material is included in the fluid.

In third embodiment of the invention a hand held battery operated version of the second embodiment of the invention is provided. This version functions in the same manner as the above with respect to tablet crushing and mixing however it is not feasible to include an automatic cleaning system which functions in association with a water supply and waste water container. It is however envisaged that automatic or manual cleaning could be effected with tap water.

In a further embodiment of the invention any embodiments of the invention, including those described herein, may be provided with a sensor device which can decode an encrypted patient identifying device and also that patient's corresponding medication requirements as prescribed. It is further envisaged that any of the embodiments of the invention can be provided with a sensor, such as a light scanning means or weighing means, to determine whether the correct medication has in fact been dispensed.

Whilst we have described herein various specific embodiments of the invention it is envisaged that other embodiments of the invention will exhibit any number of and any combination of the features previously described and it is to be understood that variations and modifications in the invention can be made without departing from the spirit and scope thereof.

The claims defining the invention are as follows:

1. An apparatus for converting tablet material into a palatable fluid, comprising:

a removable and disposable container into which tablet material for medication and a palatable fluid are placeable; and, processing means for automatically disintegrating the tablet material and concurrently dispersing the tablet material into the palatable fluid in said removable and disposable container, said processing means being located remotely from, and entirely outside of, said removable and disposable container for rendering the tablet material ingestible in a fluidized form, and with said processing means for automatically disintegrating the tablet material including means for ultrasonically disintegrating the tablet material that includes an ultrasonic probe having a sound with a frequency greater than 20 kHz.

2. The apparatus for converting tablet material into a palatable fluid according to claim 1, wherein said removable and disposable container has a flat base.

3. The apparatus for converting tablet material into a palatable fluid according to claim 1, further comprising a cup guide for supporting said removable and disposable container.

4. The apparatus for converting tablet material into a palatable fluid according to claim 3, further comprising a plurality of fiber optic sensors with said cup guide having apertures for permitting said plurality of fiber optic sensors to view contents contained within said removable and disposable container.

5. The apparatus for converting tablet material into a palatable fluid according to claim 4, wherein said plurality of fiber optic sensors is two fiber optic sensors for detecting a presence of said removable and disposable container and a level of liquid in said removable and disposable container.

6. The apparatus for converting tablet material into a palatable fluid according to claim 3, further comprising an infra-red temperature transducer with said cup guide having apertures for permitting said infra-red temperature transducer to view contents within said removable and disposable container.

7. The apparatus for converting tablet material into a palatable fluid according to claim 1, further comprising a temperature transducer for determining temperature of the tablet material ingestible in a fluidized form and whether the fluidized form is becoming overheated during ultrasonic disintegration.

8. A method for converting medication formed as a tablet into a palatable fluid, comprising the steps of:

adding a palatable fluid to a container;

placing a tablet containing medication into said container for forming a tablet/fluid combination; and, disintegrating said tablet/fluid combination via means remote from, and entirely outside of, said container until said tablet is disintegrated and dispersed throughout said palatable fluid, said disintegrating step being carried out by ultrasonically disintegrating said tablet using an ultrasonic probe having a sound frequency greater than 20 kHz and simultaneously mixing said tablet with said palatable fluid, thereby forming a palatable mixture in said container for ingestion by a patient.

9. The method for converting medication formed as a tablet into a palatable fluid according to claim 8, wherein said container has a flat base.

10. The method for converting medication formed as a tablet into a palatable fluid according to claim 8, further comprising the step of:

determining temperature of the palatable fluid and whether the palatable fluid is becoming overheated during ultrasonic disintegration.

11. The method for converting medication formed as a tablet into a palatable fluid according to claim 10, wherein said step of determining temperature of the palatable fluid is performed using an infra-red temperature transducer.

* * * * *